US005085589A

United States Patent [19]

Kan

[11] Patent Number: 5,085,589

[45] Date of Patent: Feb. 4, 1992

[54] GROUNDING BOARDLOCK FOR CONNECTOR

[75] Inventor: Ko-Chien Kan, Taipei, Taiwan

[73] Assignee: Foxconn International, Inc., Sunnyvale, Calif.

[21] Appl. No.: 645,554

[22] Filed: Jan. 24, 1991

[51] Int. Cl.[5] ..... H01R 4/66

[52] U.S. Cl. ..... 439/92; 439/567; 439/607

[58] Field of Search ..... 439/83, 89, 92, 95, 439/557, 567, 573, 607

[56] References Cited

U.S. PATENT DOCUMENTS

| | | | |
|---|---|---|---|
| 4,842,552 | 6/1989 | Frantz | 439/573 X |
| 4,943,244 | 7/1990 | Teck et al. | 439/567 |
| 5,024,607 | 6/1991 | Kachlic | 439/567 |

*Primary Examiner*—Eugene F. Desmond

[57] ABSTRACT

A one-piece boardlock formed from an elongated metallic strip comprises a vertical mounting portion, and an integral horizontal portion extending from one end of the vertical portion. At the end of the horizontal portion remote from the vertical portion a pair of side legs are formed from two laterally spaced side portions by three successive right-angle bends so that the side legs project perpendicularly from the strip. Similarly, a pair of auxiliary legs are formed from an intermediate portion of the horizontal strip portion by stamping and bending. These four legs are positioned symmetrically around a central axis perpendicular to the horizontal strip portion. An outwardly inclined cam surface is provided adjacent each leg end, and an inwardly inclined cam surface is positioned intermediate the outwardly inclined cam surface and each leg end. Such four outwardly inclined cam surfaces are located almost at the same height so that equivalent symmetrical forces act on the edge of a mounting aperture in the board when the connector and the board are combined together.

5 Claims, 6 Drawing Sheets

GROUNDING BOARDLOCK FOR CONNECTOR

BACKGROUND OF THE INVENTION

1. Field of the Invention

The present invention relates to electrical connectors, and more particularly to a reliable boardlock for securing and grounding a connector to its associated printed circuit board.

2. Description of the Prior Art

The known prior art relating to this invention includes two groups of United States Patents.

The first group includes U.S. Pat. Nos. 4,865,555; 4,842,552; 4,824,398; 4,679,883; and 4,512,618. The structure of the boardlock disclosed in these patents has a central axis and comprises a body symmetrical about the central axis and received in a corresponding recess of the connector housing in an interference fit. This type boardlock functions only as a locking means.

The second group includes U. S. Pat. Nos. 4,938,704; 4,857,017. As shown in FIG. 1, the basic structure of boardlock comprises a flat metal fixedly connected to the vertical portion of a housing flange and a pair of legs extending downwardly in the rear portion. This kind boardlock functions as not only a locking means but also a grounding means. In details, at the end of each leg an expansion part is formed as a claw at an angle of 90 degrees to the corresponding leg, by which the connector is held on the board as shown in FIG. 2. As the pair of legs are inserted into the aperture of the board, each claw confronts the lower edge of the aperture on the back surface so as to secure the connector to the board. Due to the upper edge of the claw being at a right angle to the side edge of the leg, upon inserting the connector legs into the aperture of the board there is a space occurring between the connector and the board if the thickness of the board is smaller than ordinary, so it is impossible for the claws to hold the connector firmly on the board. In contrast, the claws cannot go completely through the aperture of the board to abut against the back edge of the board if the board is thicker than ordinary. In other words, this type boardlock is not well adapted to secure a connector to printed circuit boards of different thickness. Furthermore, referring to the cross-sectional view shown in FIG. 3, there are only two points contact between the legs and the aperture, so there remains the possibility for the connector to swing back and forth perpendicular to the line including these two points. This disadvantage effects the reliability of electrical connection between the connector and the board. A modified boardlock as shown in FIG. 4 constitutes an improvement for fastening the connector to the board. An additional leg is laterally offset out of the plane of the other two legs and disposed on a center line extending medianly between the two other legs. As shown in the cross-sectional view of FIG. 5, a three-point contact is thus formed between the three legs of the boardlock and the aperture of the board so that greater reliability is obtained than is possible with the two-point contact of FIG. 2.

There are a number of disadvantages resulting from this type boardlock. Some of these include a lack of grounding effect, insufficient retention force, and inability to accommodate different thicknesses of PC board. That is, with this type boardlock the area of contact between each leg of the boardlock and the aperture of the board is insufficient for reliable stability even though there is a three-point contact. For the same reason, the grounding effect through these three points of contact is not sufficiently reliable. In addition, for the aforementioned reasons the claws of the leg being fixed in their dimensions, cannot penetrate through the aperture to abut against the back side of the board if the board is thicker than that of the design specification. In contrast, a space is formed between the board and the connector so that no substantial or reliable retention exists between the connector and the board if the board is thinner than that of the design specification. Insufficient engagement and retention effects reliability so that the connector is subject to being pulled up through the aperture during soldering, thus producing a defective connection. This also debilitates the grounding effect, and the shielding effect is incomplete, resulting in the reception of spurious signals.

Accordingly, one of the important objects of the invention is the provision of a connector member incorporating a boardlock that is adapted to accommodate boards of different thickness.

Another important object of the present invention is the incorporation into a connector member of means to enhance its grounding effect.

Yet another object of the invention is the provision of a boardlock that may be manufactured as one piece to reduce the cost, and which will function as both a locking means and a grounding means.

Still another object of the invention is the provision of a boardlock for a connector that increases the contact area between the boardlock and the board so as to stabilize the connector on the board when installed.

The invention possesses other objects and features of advantages, some of which with the foregoing will be apparent from the following description and the drawings. It is to be understood however that the invention is not limited to the embodiment illustrated and described, since it may be embodied in various forms within the scope of the appended claims.

SUMMARY OF THE INVENTION

In accordance with these and other objects, considered in terms of broad inclusion, the invention provides a one-piece boardlock comprising a vertical mounting portion, and an integral horizontal portion extending from the lower end of the vertical mounting portion. The end of the horizontal portion remote from the vertical portion is bifurcated to provide a pair of side legs lying in a common plane and formed from two outermost side edge portions of the horizontal portions by successive bends to orient the side legs so that the plane in which they lie is perpendicular to the horizontal portion. Similarly, a pair of innermost legs, also lying in a common plane, are formed from the intermediate portion of the horizontal portion so that the common plane in which they lie is perpendicular to the plane of the pair of side legs. These four legs are positioned symmetrically around a central axis that is included in both leg planes and which is perpendicular to the horizontal portion and parallel to the vertical portion. In other words, the legs are disposed at 90 degree intervals about the central axis. A radially outwardly inclined section is positioned spaced from each leg end, and a inwardly inclined integral section is positioned at each leg end so that each leg constitutes a resilient cantilever having adjacent oppositely inclined cam surfaces thereon. Such four outwardly inclined sections are positioned almost at the same height so that equivalent symmetrical camming forces act on the mounting aperture edge when the connector and the board are interconnected, thus insuring a good and constant retention force acting on the board to retain the connector on the board. When the symmetrically arranged legs are inserted into the mounting hole, the inwardly inclined leg sections cam against the hole edges and flex the legs inwardly until the outwardly inclined sections lie in the hole, whereupon the legs spring outwardly to engage the hole.

For the purpose of grounding, a grounding section is formed on the horizontal portion of each outermost leg in order to enlarge the grounding area between the connector and the board.

DESCRIPTION OF THE PREFERRED EMBODIMENT

Figure 7:
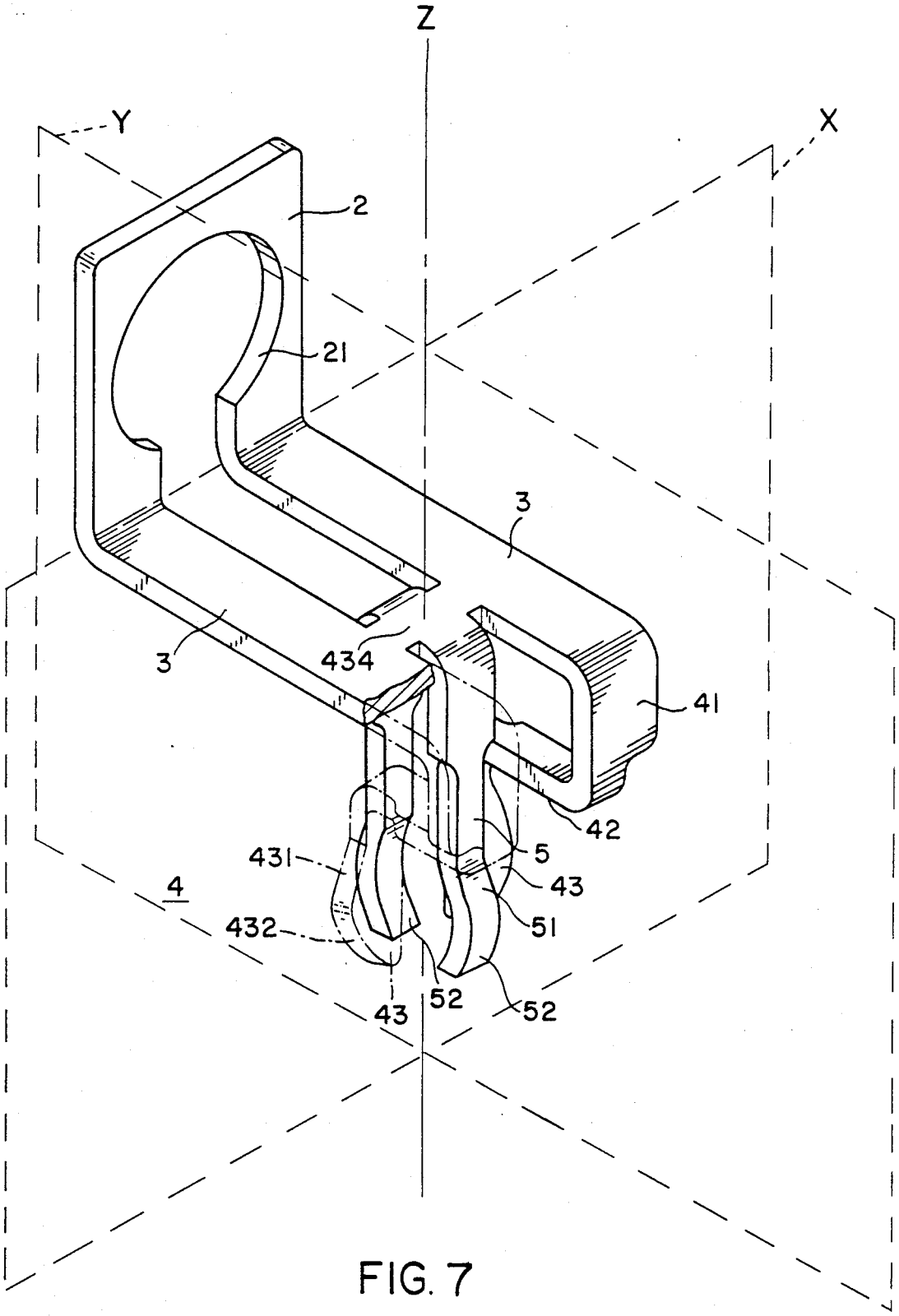
FIG. 7 is a cutaway perspective view showing in full lines the underlying structural portions hidden in FIG. 6. The structure is shown in relation to perpendicular X and Y planes and a vertical Z axis included in both planes.

In the interest of clarity in the description of this invention, the configuration of the boardlock is illustrated in FIG. 7 in relation to X and Y planes and a Z axis.

In terms of greater detail, one of the purposes of the present invention is to solve the problem of mechanical stabilization and electrical grounding of the boardlock when incorporating the connector on a PC board having connector-mounting apertures. FIG. 1 through 5 illustrate prior art structures that fail to satisfactorily solve these problems for reasons that are apparent from a cursory examination of these structures.

Figure 1:
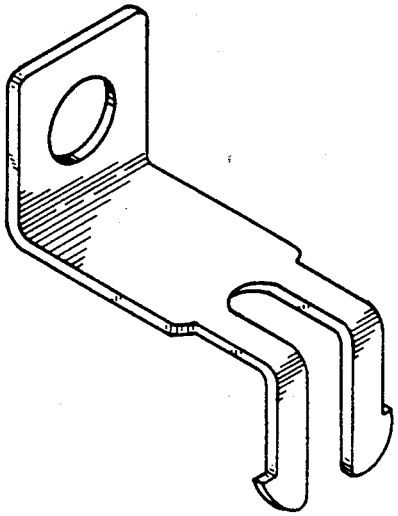
FIG. 1 (PRIOR ART)
FIG. 1 is a perspective view of the prior art boardlock having only two legs lying in a common vertical plane and shoulders spaced a predetermined and fixed distance from the horizontal portion of the boardlock body.
Figure 2:
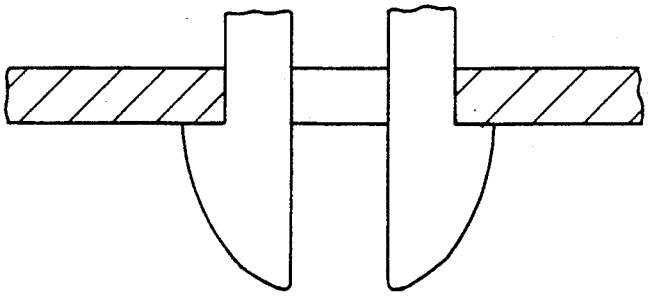
FIG. 2 (PRIOR ART)
FIG. 2 is a vertical cross-sectional view partly in elevation showing the prior art boardlock legs of FIG. 1 when the connector and the board are assembled together.
Figure 3:
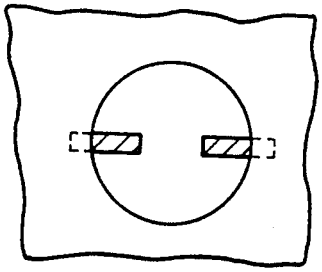
FIG. 3 (PRIOR ART)
FIG. 3 is a horizontal cross-sectional view partly in plan of the prior art boardlock of FIG. 1 when assembled.
Figure 4:
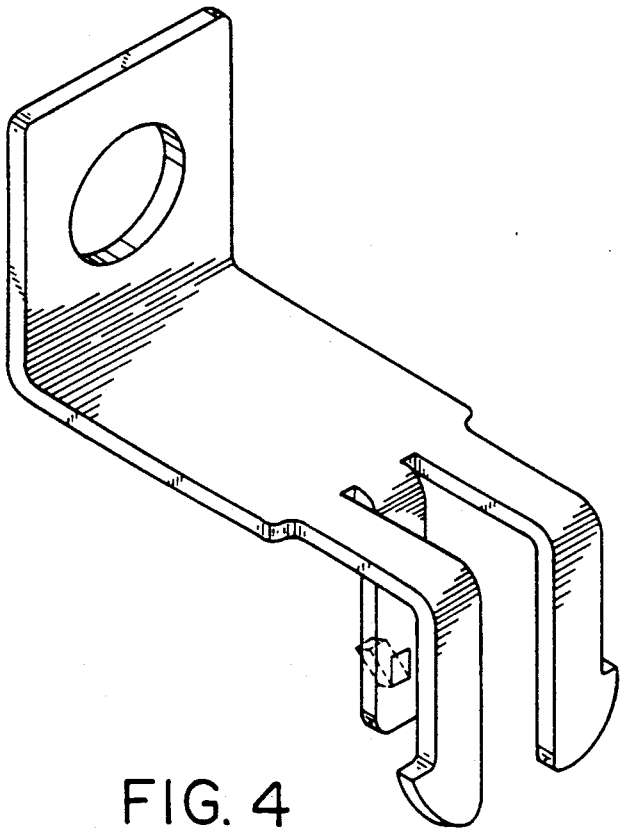
FIG. 4 (PRIOR ART)
FIG. 4 is a perspective view of another prior art boardlock similar to the boardlock of FIG. 1, but with the addition of a third leg.
Figure 5:
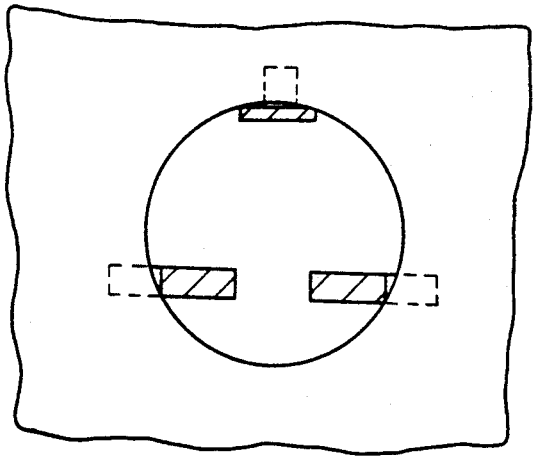
FIG. 5 (PRIOR ART)
FIG. 5 is a horizontal cross-sectional view partly in plan of the prior art boardlock of FIG. 4 when assembled.
Figure 6:
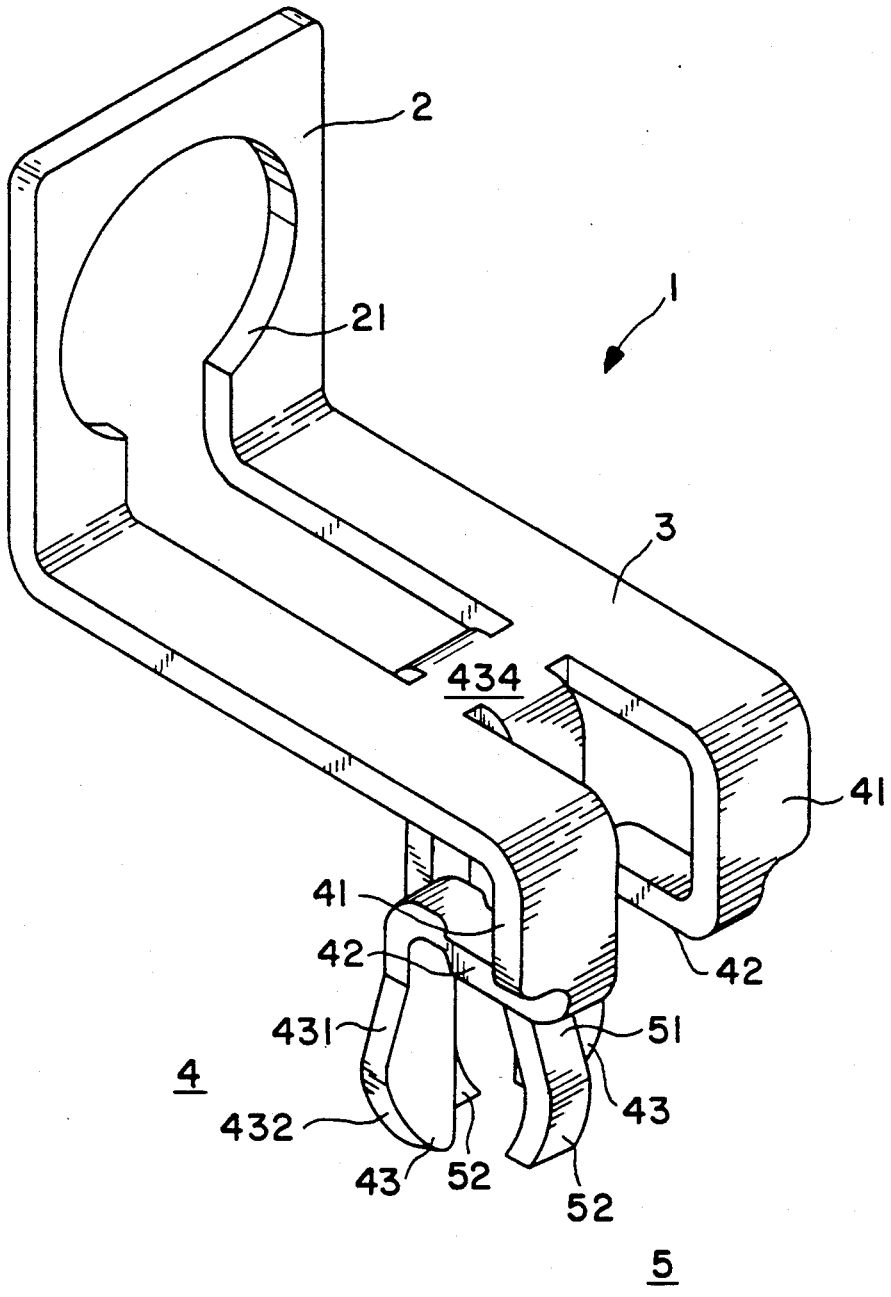
FIG. 6 is a perspective view of the present preferred embodiment of the boardlock for the connector of the present invention.

Referring now to FIG. 6 and 7, the structure forming the subject matter of this invention comprises a boardlock designated generally by the numeral 1, formed from a flat metallic strip having inherent resilience and includes a vertical portion 2 and an integral horizontal portion 3. A mounting hole 21 is located at the center of the vertical portion 2 to cooperate with a screw or a rivet (not shown) for fastening the boardlock I to the connector partially shown in FIG. 8 and shown in perspective in FIG. 10. Along two outermost side portions, a first pair of laterally spaced side legs designated generally by the numeral 4 are formed in parallel relation and lying in the X plane and spaced on opposite sides of the Y plane. The legs 4 are formed by three successive right angle bends as shown. Each side leg 4 comprises a first integral section 41 extending perpendicularly from the end of the associated horizontal portion 3, a second section 42 extending from the associated end of the first section 41 bent forwardly in a reentrant portion lying spaced from and parallel to the horizontal portion 3, and a third section 43 extending integrally from the associated end of the second section 42 and extending perpendicular to the section 42 and horizontal portion 3. In the view of the third section 43 of the side leg 4 illustrated in FIG. 6 and 9, an outwardly inclined surface 431 is formed on each leg in the upper portion thereof, and an inwardly inclined surface 432 is formed on each leg in the lower portion thereof as shown. In other words, the outwardly inclined surfaces 431 and the inwardly inclined surfaces 432 of the side legs 4 meet in an expanded waist having a transverse dimension greater than the diameter of the aperture 433 formed in the PC board 6. The inclined surfaces 431 and 432 thus form camming surfaces which cooperate with the inner periphery of the aperture 433.

From the middle web portion of the horizontal portion 3, a second pair of auxiliary legs 5 are struck and positioned on the opposite sides of the plane within which the side legs 4 are included. The auxiliary legs 5 are formed by directly stamping or die-cutting the horizontal portion 3 to partially sever the legs from the strip. To form the legs, one of the auxiliary legs 5 is separated severed out of the strip symmetrical with the Y plane and extends from the lower edge of the hole 21 to a designated position defined by the integral cross piece 434. Symmetrically and similarly, in a corresponding length and parallel to the first auxiliary leg 5, the second auxiliary leg 5 is divided out of the horizontal portion 3 extending from the cross piece 434 to the end of strip and cooperates with the aforementioned first auxiliary leg 5 in forming the pair of auxiliary legs 5. It should be noted that the pair of auxiliary legs 5 are included or lie in the Y plane and lie on opposite sides of the Z axis and X plane in the same manner and to the same extent that the pair of legs 4 are included in the X plane and lie on opposite sides of the Z axis. By appropriate bending, each end of the auxiliary legs 5 presents an outwardly inclined cam surface 51 in the upper portion thereof and a inwardly inclined integral cam surface 52 in the lower portion. Since the legs of the two pairs of legs 4 and 5 are spaced symmetrically about the Z axis at 90 degree intervals, it will be seen that insertion force to mount the connector results in the inner periphery of the mounting hole resiliently camming the legs inwardly toward the Z axis until the expanded waist slips past the PC board.

Figure 8:
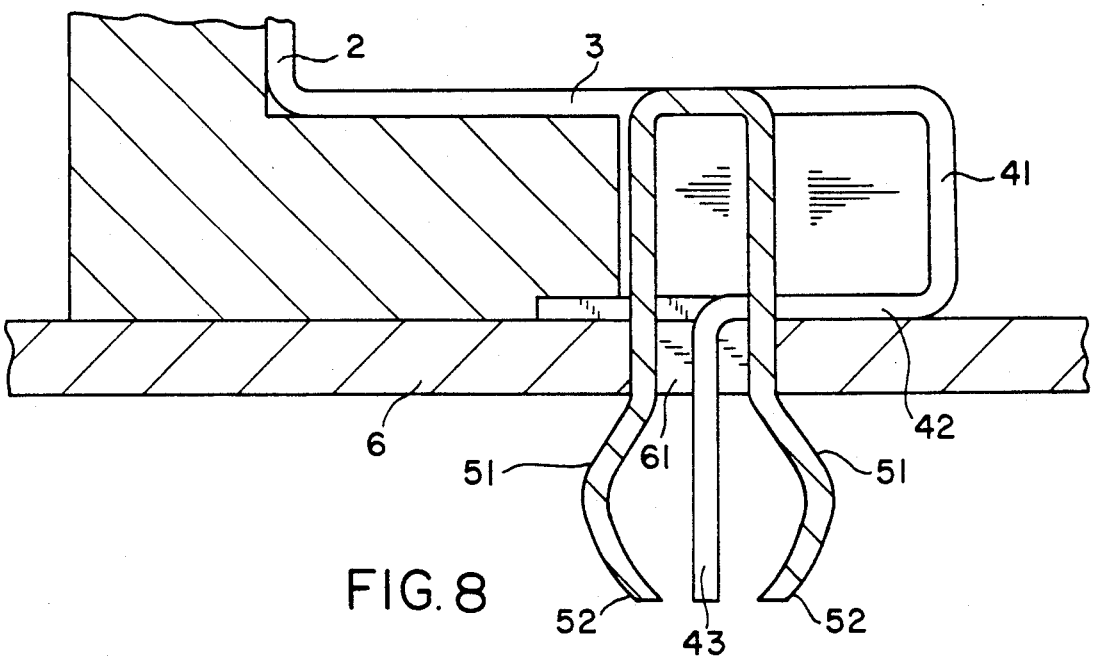
FIG. 8 is a vertical cross-sectional view taken in the Y plane and illustrating the boardlock mounted on a connector and engaging a PC board.

Referring to FIG. 8, it will be seen that the second section 42 of each side leg 4 abuts against the top surface, i.e. the grounding plane, of the board 6. This results in the provision of a larger grounding area between the connector and the board and improves the grounding effect That is, in addition to the four points of contact with inside periphery of the board's hole 61 (FIG. 8 and 9), the section 42 functions as a grounding means for the connector, thus increasing the grounding area between the board and the connector to achieve a better grounding effect.

In this embodiment, since the side leg sections 41 and 42 wrap about associated edge of the connector body, which is recessed as shown in FIG. 8 to receive the sections 42 so the they lie flush with the underside of the connector body or project slightly as shown, it is preferred to form the grounding means with the two side legs and section 42 because of better stability and larger contact area. Alternatively, the grounding means can be disposed on the auxiliary legs or both the side legs and auxiliary legs.

Figure 9:
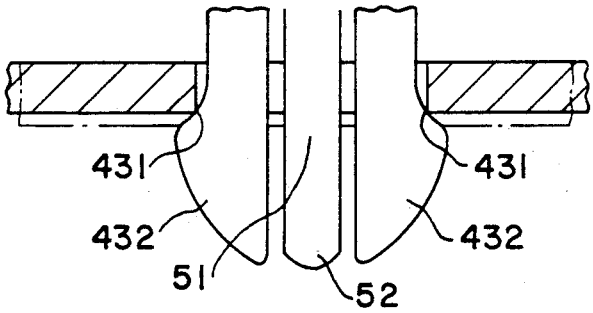
FIG. 9 is a fragmentary vertical cross-sectional view of the boardlock leg for the connector of this invention when the connector and board are assembled together and illustrating schematically the resilient force components acting to keep the connector reliably seated on the PC boards of different thickness.
Figure 10:
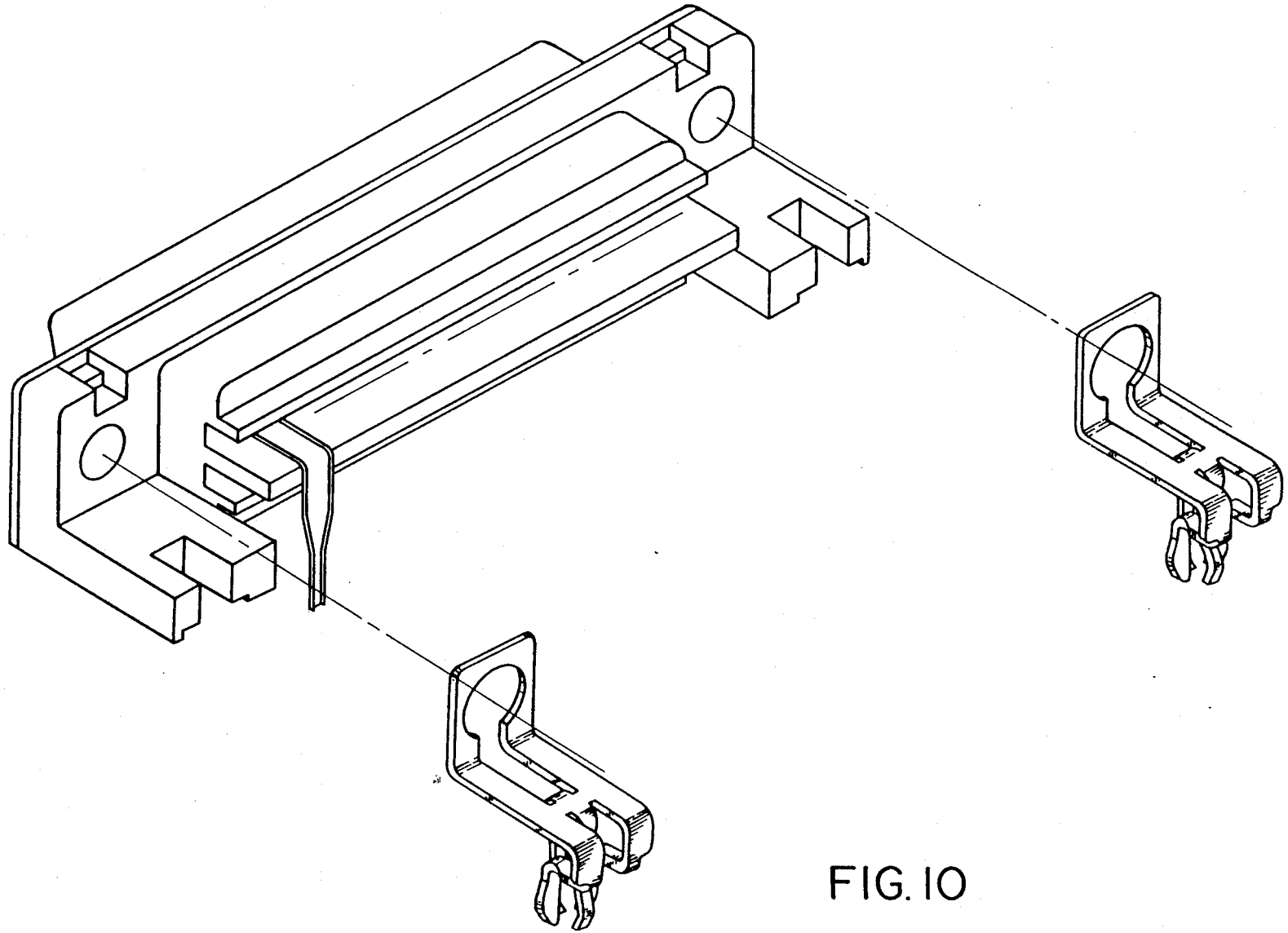
FIG. 10 is a perspective view of the present preferred embodiment of the boardlock with the associated connector.

Referring to FIG. 9, the side legs 4 and the auxiliary legs 5 are sprung inwardly when the boardlock legs are inserted into the mounting aperture 61 of the board 6 as previously explained, and then resiliently spring outwardly after the largest dimension of the four contact points between those four legs and the board's mounting aperture change from inwardly inclined cam surfaces 432, 52 of the side legs 4 and auxiliary legs 5, respectively, to outwardly inclined surfaces 431, 51 of the side legs 4 and auxiliary legs 5, respectively. In final position, a portion of the outwardly inclined surface of each side leg 4 and auxiliary leg 5 resiliently abuts against the inner edge of mounting aperture as shown. It is apparent that by means of their resilient character and inclined cam surfaces, the legs are in abutment against the board through some portion or point of the outwardly inclined surfaces 431 of the side legs or 51 of the auxiliary legs 5, regardless of reasonable variations in the thickness of the board due to failure to hold manufacturing tolerances. It can be seen that the resilient character of the legs in the present invention is deemed better than that of the non-resilient tubular body type boardlocks illustrated in the first group of the prior art patents discussed above.

It should be noted that the outwardly inclined cam surfaces of the four legs are preferred to be positioned at the same height in relation to the underside of the connector so that the retention force occurring between the boardlock and the board is equal and symmetric to stabilize the connector.

It should be understood that the resilient legs are not limited to two pairs. Substitutionally, a greater number plurality of pairs of legs may be formed or stamped from the plane portion of boardlock strip, and spaced from each other an equal distance preferably, in the interest of symmetry.

It should be noted that in the present invention because a plane type, i.e. four points, connection is provided on each connector boardlock, there is no tendency for the connector to swing in relation to the board. Another advantage of the present invention is the provision of a larger grounding area between the boardlock and the board so as to increase the shielding function from electromagnetic interference and spurious signals. In addition, owing to the excellent spring character and outwardly inclined cam surfaces of the legs, when there occurs a difference in board thickness or mounting aperture size from the standard, nevertheless, the boardlock is easy to mount, and provides a good cooperative relation between the boardlock and the board so that the connector can be held firmly and reliably on the board. For the same reason, because of the outwardly inclined cam surfaces of the legs, they lock resiliently against the lower edge of the board's mounting aperture, and prevent the connector from being dislodged outwardly due to the pressure of the soldering process.

Having thus described the invention, what is believed to be new and novel and sought to be protected by letters patent of the United States is as follows.

We claim:

1. A boardlock for a connector comprising:

a metallic strip having a vertical portion adapted for fastening to the connector;

an integral horizontal portion extending perpendicularly from the vertical portion and adapted to overlie an adjacent parallel portion of the connector;

at least a pair of laterally spaced side legs formed from laterally spaced portions of the horizontal portion bent perpendicularly out of the plane of said horizontal portion, said side legs lying in a plane perpendicular to the longitudinal dimension of said metallic strip;

at least a pair of auxiliary legs formed from portions of the horizontal portion intermediate said laterally spaced portions and bent perpendicularly out of the plane of said horizontal portion, said pair of auxiliary legs being spaced apart in the direction of said longitudinal dimension and lying in a median plane including said longitudinal dimension; and an upper outwardly inclined cam surface and a lower inwardly inclined cam surface formed on each leg, said legs of said pairs of legs being equally spaced circumferentially about a central axis perpendicular to said horizontal portion of said metallic strip.

2. The boardlock for the connector according to claim 1, wherein each side leg is formed by three right angle bends to provide three integral leg sections, at least two of said sections constituting a grounding means for said boardlock.

3. The boardlock of the connector according to claim 2, wherein said side and auxiliary legs include outwardly inclined camming surfaces at a common height from said horizontal portion.

4. The boardlock of the connector according to claims 2, wherein one of said grounding means includes a surface portion of a reentrant section of each side leg lying spaced from and parallel to said horizontal portion, and the other grounding means includes upper outwardly inclined camming surfaces formed on said laterally spaced side legs.

5. A boardlock for a connector comprising a metallic strip having a vertical portion adapted for fastening to the connector; an integral horizontal portion extending perpendicularly from the vertical portion and adapted to overlie an adjacent parallel portion of the connector; the improvement comprising:

at least three legs extending from the horizontal portion, at least one of said legs being formed by three right angle bends to provide three integral leg sections among which two of said sections constitute a grounding means for said boardlock, at least two of said legs including outwardly inclined camming surfaces and inwardly inclined camming surfaces.

* * * * *